United States Patent [19]

Hicks

[11] Patent Number: 4,722,438

[45] Date of Patent: Feb. 2, 1988

[54] ORGANIZER CONTAINER FOR GARMENT HANGERS

[76] Inventor: Rexford L. Hicks, P.O. Box 426, Camden, Tenn. 38320

[21] Appl. No.: 37,459

[22] Filed: Apr. 13, 1987

[51] Int. Cl.[4] ..... B65D 85/00

[52] U.S. Cl. ..... 206/300; 223/85

[58] Field of Search ..... 206/300; 223/85

[56] References Cited

U.S. PATENT DOCUMENTS

| | | | |
|---|---|---|---|
| 1,591,087 | 7/1926 | Holliday | 206/300 |
| 2,609,919 | 9/1952 | Lee | 206/300 |
| 3,145,835 | 8/1964 | Byassee | 206/300 |
| 3,987,898 | 10/1976 | Crane | 206/300 |

*Primary Examiner*—William Price

*Attorney, Agent, or Firm*—Pitts and Brittian

[57] ABSTRACT

A storage container for garment hangers with organizer capabilities to substantially eliminate entangling of the hangers. This storage container has a rear wall and an effective front wall disposed at an angle to the rear wall that substantially conforms to the angle between the arm portions of a hanger and the base portion. Both the rear wall and the front wall have confronting projections that define grooves in the surfaces of these walls. These grooves serve to align hangers as they are deposited therein so as to sufficiently prevent entangling between the hangers such that a single selected hanger can be removed from the container. In the preferred embodiment the two confronting projections join in the base of the container. Furthermore, the rear wall typically is provided with a slot-type aperture to form a carrying handle, and with other apertures to provide for the hanging of the container upon a vertical support surface. Several embodiments are described as well as a preformed modular unit that can be used with a conventional container to produce the present invention or can be used separately in other applications.

16 Claims, 4 Drawing Figures

ORGANIZER CONTAINER FOR GARMENT HANGERS

DESCRIPTION

TECHNICAL FIELD

The present invention relates generally to open-topped storage containers, and more particularly to a container for the organized storage of garment hangers to be used in the home, laundries, stores, and the like, to minimize tangling of the hangers with each other so that individual hangers can be easily withdrawn from the container for use.

BACKGROUND ART

There is an ever-present problem with the entangling of garment hangers when they are not in use supporting a garment. This is particularly true when loose hangers are deposited in a bundle or placed in some container. It is typical that in the home a group of hangers are usually stored in the laundry area for use on wash day to put shirts, blouses, slacks, etc. on a hanger after drying so that those garments can be returned to a closet for storage until use. Frequently these loose hangers are placed in some type of container, such as an extra waste basket.

The problem of garment hanger entanglement is even greater in garment manufacturing facilities, department and specialty stores where garments are sold, etc. For these facilities, large numbers of garment hangers are stored in some type of bin and are then withdrawn individually to be put in some form of garment. The entanglement is particularly a problem with wire-type hangers; however, a similar problem is encountered with plastic and wooden hangers.

The entanglement problem of hangers has not really been addressed in the known prior art. U.S. Pat. No. 1,591,087 issued to J. F. Holliday on July 6, 1926, discloses a sales package for garment hangers wherein a plurality of hangers are handled as a unit. It does not provide for a "sorting" of the hangers so as to prevent entanglement of loosely deposited hangers nor does it permit withdrawal of a certain hanger without disturbing the other hangers. U.S. Pat. No. 3,145,835 issued to G. E. Byassee on Aug. 25, 1964, also discloses a box-like receptacle for transport of garment hangers in an untangled manner. This does not, however, provide for rapid deposit of hangers into a container as would be desirable for the above-described uses in the home, department store, etc. The other known art in this general field is disclosed in U.S. Pat. No. 3,987,898 issued to W. B. Crane on Oct. 26, 1976. Of the known art, this is the closest art to a device wherein garment hangers can be deposited in an untangled manner and then withdrawn when needed. However, even in this '898 patent, hook portions of adjacent hangers can become entangled and only the top hanger can be withdrawn.

Accordingly, it is a principal object of the present invention to provide a container that will accept garment hangers for storage in a manner to minimize any entanglement thereof such that an individual hanger can be selected and easily withdrawn when desired.

It is another object of the present invention to provide a container for the storage of garment hangers, the container having a configuration for separating adjacent hangers or groups of hangers as they are deposited therein such that the hangers stored therein are not entangled and such that an individual hanger can be easily withdrawn even when all hangers are not the same size or design.

It is still another object to provide an open-topped container that will receive garment hangers in a vertical orientation, the container having a configuration for aligning the hangers vertically in a non-entangled manner.

It is also an object of the present invention to provide an insert to be used in a conventional open-topped container, such as a generally rectangular waste basket, the insert having a configuration for aligning hangers deposited therein in a vertical orientation in a non-entangled manner.

It is a further object to provide a garment hanger storage unit that can be attached to the wall, utilized on turn tables or carrousels, rolling carts and similar structures as used in warehouses, factories, cleaners, laundries, etc.

These and other objects of the invention will become apparent upon a consideration of the drawings which follow, and the detailed description thereof.

SUMMARY OF THE INVENTION

In accordance with the portable embodiment of the present invention, there is provided a generally rectangular container having an open top. The inner surface of the front and rear walls of the container have confronting ridges or other type projections so as to provide grooves in these surfaces. The projections can be integrally formed with the front and rear walls, or can be provided by an appropriately configured insert for the container. The resultant grooves permit the deposit of a garment hanger in a generally vertical orientation into the container such that the hangers will be organized and stored in a vertical orientation without entangling with adjacent hangers. In a preferred embodiment, the rear wall is provided with apertures to form a carrying handle and with other apertures to permit the releasable hanging of the container on a wall or other supporting surfaces.

Other embodiments utilize confronting front and rear ridges for proper organization of garment hangers and thereby permit removal of any selected hanger.

DETAILED DESCRIPTION OF THE INVENTION

Figure 1:
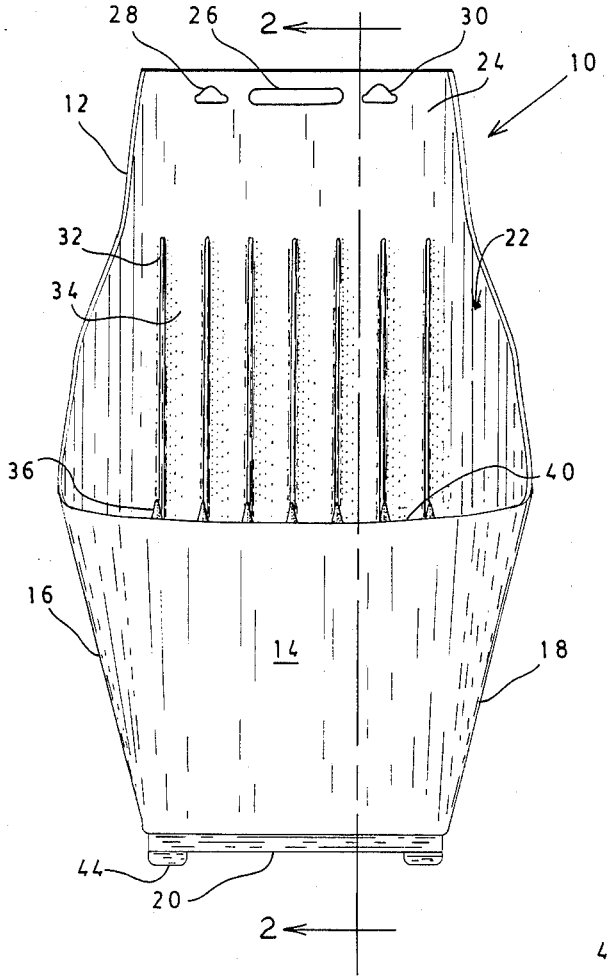
FIG. 1 is a front elevational view of one embodiment of the present invention.
Figure 2:
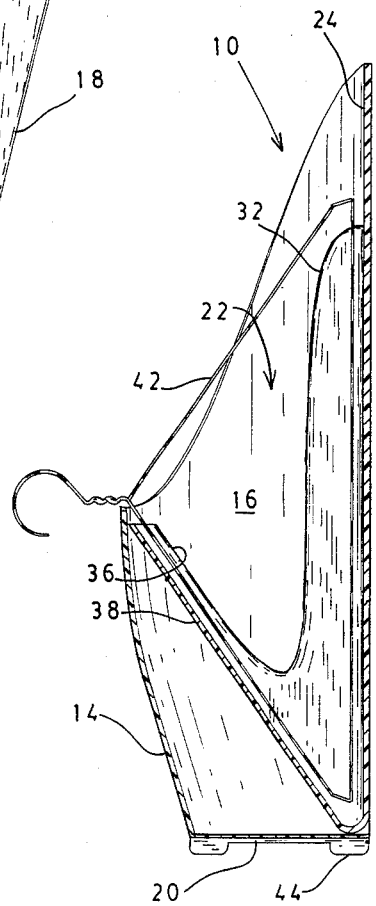
FIG. 2 is a cross-sectional view of the embodiment of FIG. 1 taken at 2—2 thereof.

The portable embodiment of the present invention can be best described with reference to FIGS. 1 and 2. This embodiment of the invention, shown at 10 therein, is a container of generally rectangular configuration defined by a rear wall 12, a front wall 14, end walls 16, 18 and a bottom 20. Although the bottom 20 is illustrated as being continuous, for molding ease it preferably is only peripheral around a central opening. The wall components define an open top 22. In this particular embodiment, the rear wall 12 extends upward with an upper portion 24 above the upper edges of the front and end walls. Within this upper portion 24 there is provided a slot-type aperture 26 to serve as a carrying handle for the container. In addition, there are provided two other apertures 28, 30 for use in hanging the container on a suitable vertical supporting surface, such as a door or wall. These apertures 26, 28, 30 are for convenience and are not essential to the invention.

Vertically aligned on the rear wall 12 are a plurality of ridges or projections 32 generally equally spaced apart which define vertical grooves or pockets 34. Preferably these ridges project at least one inch from the rear wall surface. Confronting ridges or projections 36 are provided on the inner surface of the front wall 14 (or in this embodiment on a false front wall 38) to define vertical grooves or pockets 40. The amount of projection of these ridges 36 can be less than those on the rear wall. The rear projections 32 and the front projections 36 can be continuations of each other, as illustrated in FIG. 2, can be entirely separate or can have a bridge therebetween at their lower ends. Preferably the front wall (14 or 38) should slant inwardly toward the rear wall near the bottom 20 so as to conform to the angle formed between arm portions and a line joining ends of the arms of garment hangers such as shown at 42 in FIG. 2. This is the reason for the false front wall 38 in this embodiment. In this manner, a garment hanger can be loosely dropped into the container and it will automatically be aligned in corresponding grooves 34 and 40 such that it will be stored in an organized, e.g. unentangled, manner for subsequent removal for use. When a hanger is stored in the container, the hook element of the hanger is disposed proximate the upper edge of the front wall (14 or 38). The projections 32 and 36 can be integrally formed as straight projections from their respective supporting surfaces, or they can have a curved contour at the junction with their supporting surfaces. This will be a choice available to a manufacturer of the container as to mold configuration. If desired, the container can be provided with integral "feet" 44 to maintain the bottom 20 above a horizontal supporting surface.

Figure 3:
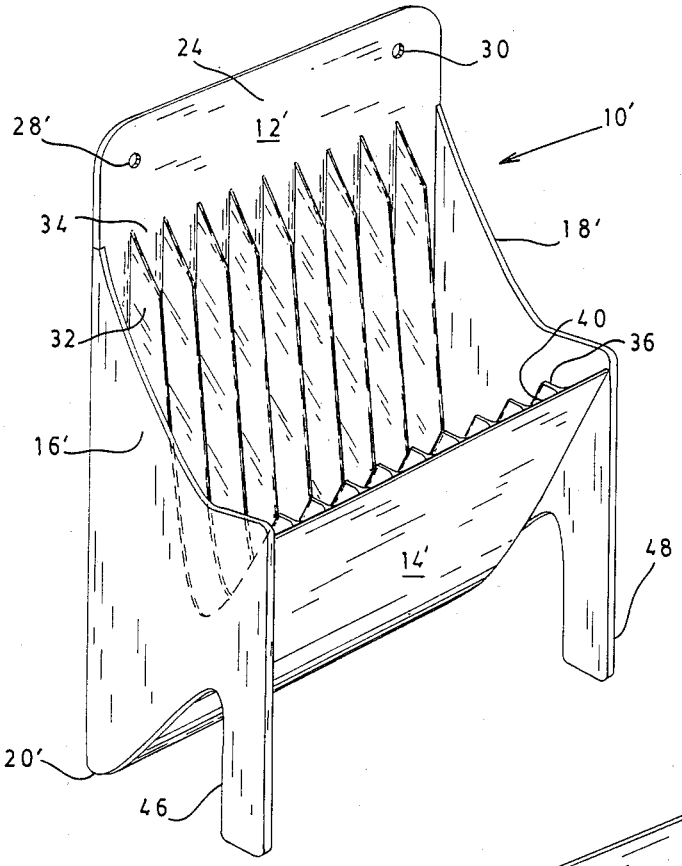
FIG. 3 is an isometric view of another embodiment of the present invention.

Another embodiment of the present invention is illustrated at 10' in FIG. 3. In this embodiment the front wall 14' itself is sloped inwardly toward the rear wall 12' near the bottom 20' to form an angle corresponding to that of a garment hanger. The end walls 16', 18' are generally triangular in shape, and legs 46, 48 can be formed integrally therewith as shown, or can be separately formed elements. Also, if the device is to be used only as a wall unit, it can be fabricated without the legs 46, 48. As in the embodiment of FIGS. 1 and 2, there are projections 32 extending from the rear wall 12' and confronting projections 36 extending from the front wall 14' to form the grooves 34 and 40, respectively. This embodiment also permits garment hangers to be lowered into the container so as to be spaced by the projections such that the hangers do not become entangled.

Figure 4:
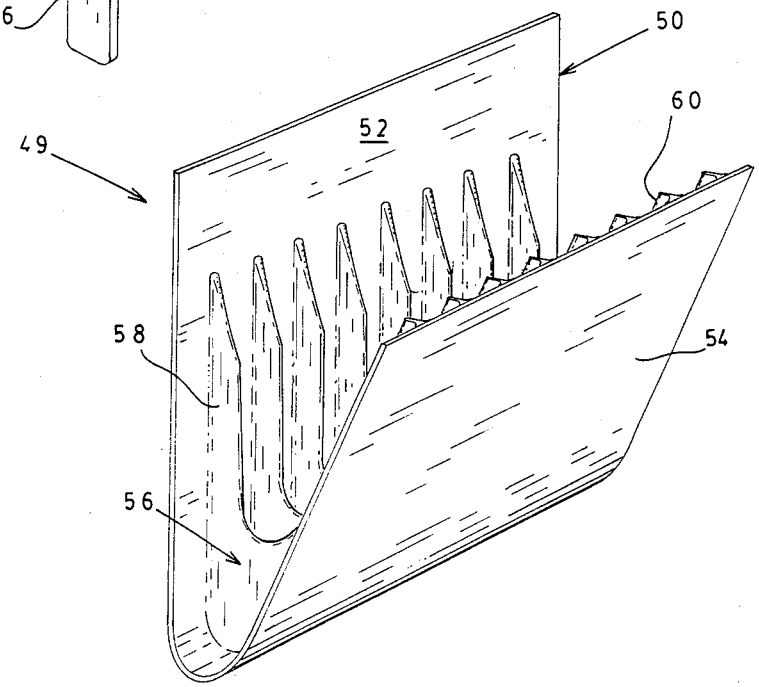
FIG. 4 is an isometric view of an insert unit for a conventional container such that insertion of this unit produces an embodiment of the present invention similar to that of FIG. 1.

A preformed liner or modular unit 49 is illustrated in FIG. 4. This unit is suitable for use in a standard container to create the present invention. This unit is also suitable for hanging on a wall, rolling cart, carrousel, etc. The modular unit utilizes, for example, a single sheet of material 50 to form a rear wall 52 and a front wall 54. Continuous projections 56 on the sheet 50 form, in turn, the projections 58 on the rear wall 52 and projections 60 on the front wall 54. An angle between the front wall and the rear wall corresponds to the angle found on garment hangers. Of course, this insert could be produced using two sheets joined at the bottom rather than a single sheet.

The present invention in its many forms can be fabricated, for example, of a suitable plastic in a mold. As illustrated in FIGS. 1–3, the taper of all the wall components will permit the withdrawal of a mold piece after fabrication. Further, this taper is suitable for making the units stackable. This is of value in saving shipping and storage space.

From the foregoing it will become apparent that a practical storage unit for garment hangers has been developed. The unit depicted in the FIGS. 1–3 are sized principally for the home; however, units of other sizes will be of use in department and variety stores, laundries and other facilities where garment hangers are to be stored in bulk for future use. Thus, there is no intent to limit the invention by the limited number of embodiments illustrated or the number of storage "compartments" within each unit. Rather, the invention is to be limited only by the appended claims and their equivalents when taken together with the complete description herein.

I claim:

1. An organizer-type container for the untangled storage of garment hangers, said hangers having arm portions disposed at a selected angle to a line joining ends of said arm portions, and a hook element at a junction of said arm portions, said container comprising:

a rear wall, said rear wall having outwardly extending vertical projections defining grooves therebetween, said rear wall defining an upper portion and a bottom edge;

a front wall, said front wall having inwardly extending vertical projections in confronting relationship with said projections on said rear wall, said projections on said front wall defining grooves therebetween, said front wall defining an upper edge and a bottom edge; and means for joining said front wall to said rear wall at said bottom edges such that an angle is defined between said front wall and said rear wall at said bottom edges that substantially conforms to said angle of said hangers whereby when said hangers are deposited within said container, said grooves in said rear wall and said front wall guide said hangers to a stored position whereby said hangers are not entangled.

2. The container of claim 1 further comprising end walls joining said front wall to said rear wall.

3. The container of claim 2 further comprising foot elements disposed proximate said bottom edges whereby said container can be supported upon a horizontal support surface.

4. The container of claim 1 wherein said upper edge of said front wall is disposed proximate said hook element of said hangers when said hangers are stored in said container.

5. The container of claim 1 wherein said upper portion of said rear wall is disposed at a higher level than said upper edge of said front wall, and said upper portion of said rear wall is provided with a transverse slot-type aperture to form a carrying handle for said container.

6. The container of claim 1 wherein said upper portion of said rear wall is disposed at a higher level than said upper edge of said front wall, and said upper portion of said rear wall is provided with at least one aperture for receiving fastening elements to support said container upon a vertical support surface.

7. The container of claim 2 further comprising a secondary front wall joined to said front wall at said upper edge and to said end walls whereby said secondary front wall, said rear wall and said end walls define a substantially rectangular exterior configuration.

8. An organizer-type container for the untangled storage of garment hangers, said hangers having arm portions disposed at a selected angle to a line joining ends of said arm portions, and a hook element at a junction of said arm portions, said container comprising:

a rear wall, said rear wall having outwardly extending vertical projections defining grooves therebetween, said rear wall defining an upper portion and a bottom edge;

a front wall, said front wall having inwardly extending vertical projections in confronting relationship with said projections on said rear wall, said projections on said front wall defining grooves therebetween, said front wall defining an upper edge and a bottom edge, said front wall disposed at an angle with respect to said rear wall that substantially conforms to said angle of said hanger;

first and further end walls joined between said rear wall and said front wall, said end walls each defining an upper edge and a bottom edge; and a bottom member joined between said bottom edges of said rear wall, said front wall and said end walls.

9. The container of claim 8 wherein said rear wall, said front wall, said end walls and said bottom member are integrally formed, and further comprises foot elements integrally formed with said bottom member whereby said container can be supported on a horizontal surface.

10. The container of claim 8 wherein said upper edge of said front wall is disposed proximate said hook element of said hangers when said hangers are stored in said container.

11. The container of claim 8 wherein said upper portion of said rear wall is disposed at a higher level than said upper edge of said front wall, and said upper portion of said rear wall is provided with a transverse slot-type aperture to form a carrying handle for said container.

12. The container of claim 8 wherein said upper portion of said rear wall is disposed at a higher level than said upper edge of said front wall, and said upper portion of said rear wall is provided with at least one aperture for receiving fastening elements to support said container upon a vertical support surface.

13. The container of claim 8 further comprising a secondary front wall joined to said front wall at said upper edge, to said end walls and to said bottom member whereby said secondary front wall, said rear wall, said end walls and said bottom member define a substantially rectangular exterior configuration.

14. An organizer-type container for the untangled storage of garment hangers, said hangers having arm portions disposed at a selected angle to a line joining ends of said arm portions, and a hook element at a junction of said arm portions, said container comprising:

a front wall, said front wall having inwardly extending vertical projections, said projections on said front wall defining grooves therebetween, said front wall defining an upper edge and a lower edge;

a rear wall, said rear wall having outwardly extending vertical projections in confronting relationship with said projections on said front wall defining grooves therebetween, said rear wall defining an upper portion and a bottom edge said upper portion of said rear wall being disposed at a higher level than said upper edge of said front wall and provided with a transverse slot aperture to define a carrying handle for said container and with at least one aperture for receiving releasable fastening elements to support said container upon a vertical support surface, said rear wall being disposed at an angle with said front wall that substantially conforms to said angle of said hanger;

first and further end walls joined between said rear wall and said front wall, said end walls each defining an upper edge and a bottom edge;

a bottom member joined between said bottom edges of said rear wall, said front wall and said end walls, said bottom member provided with foot elements whereby said container can be supported on a horizontal support surface; and wherein said front wall, said rear wall, said end walls and said bottom member are integrally formed.

15. The container of claim 14 wherein said upper edge of said front wall is disposed proximate said hook element of said hangers when said hangers are stored in said container.

16. The container of claim 14 further comprising a secondary front wall joined to said front wall at said upper edge, and to said side walls, whereby said rear wall, said secondary front wall and said end walls define a substantially rectangular exterior configuration.

* * * * *